US006966806B1

(12) United States Patent
Bruestle et al.

(10) Patent No.: US 6,966,806 B1
(45) Date of Patent: Nov. 22, 2005

(54) REPLACEABLE LEADING EDGE FOR A MARINE DRIVE UNIT

(75) Inventors: Claus Bruestle, Fond du Lac, WI (US); Wayne M. Jaszewski, Jackson, WI (US); Kevin R. Anderson, Fond du Lac, WI (US); George E. Phillips, Oshkosh, WI (US); Richard A. Davis, Mequon, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/836,509

(22) Filed: Aug. 10, 2004

(51) Int. Cl.[7] ..... B63H 20/32
(52) U.S. Cl. ..... 440/78; 440/76
(58) Field of Search ..... 440/66, 71, 76, 440/78

(56) References Cited

U.S. PATENT DOCUMENTS

| | | | | |
|---|---|---|---|---|
| 3,939,795 A | | 2/1976 | Rocka | 115/17 |
| 4,832,635 A | | 5/1989 | McCormick | 440/78 |
| 5,000,709 A | | 3/1991 | Bergeron | 440/78 |
| 5,007,868 A | | 4/1991 | Fry | 440/71 |
| 5,007,869 A | | 4/1991 | Zoellner | 440/71 |
| 5,178,565 A | | 1/1993 | Jacobson | 440/71 |
| 5,224,889 A | | 7/1993 | Hickey | 440/71 |
| 5,277,632 A | | 1/1994 | Davis | 440/71 |
| 5,399,113 A | | 3/1995 | DeMasi | 440/71 |
| 5,501,622 A | | 3/1996 | Phelan | 440/71 |
| 5,516,315 A | * | 5/1996 | Griffin | 440/66 |
| 5,536,188 A | | 7/1996 | Porta | 440/78 |
| 5,643,023 A | | 7/1997 | Sober | 440/76 |
| 5,772,481 A | | 6/1998 | Alexander et al. | 440/66 |
| 6,168,483 B1 | | 1/2001 | McIntosh | 440/71 |
| 6,406,081 B1 | | 6/2002 | Mahfet et al. | 293/133 |
| 6,503,110 B2 | | 1/2003 | Lammli | 440/71 |
| 6,669,251 B2 | | 12/2003 | Trappe | 293/120 |
| 6,679,544 B1 | | 1/2004 | Hubbert et al. | 196/187.05 |

* cited by examiner

*Primary Examiner*—Stephen Avila
(74) *Attorney, Agent, or Firm*—William D. Lanyi

(57) ABSTRACT

A marine propulsion device is made of first and second portions which are removably attachable to each other. The second portion is the leading edge portion of the nose cone and the drive shaft housing. It can also comprise a portion of the skeg. The second portion is configured to crush more easily in response to an impact force than the first portion. This can be accomplished by making the second portion from a different material than the first portion, which can be aluminum, or by providing one or more crush boxes within the structure of the second portion to cause it to yield more quickly to an impact force and thus protect the first portion which is the more critical structure of the marine device.

24 Claims, 3 Drawing Sheets

REPLACEABLE LEADING EDGE FOR A MARINE DRIVE UNIT

BACKGROUND OF THE INVENTION

1. Field of the Invention

The present invention is generally related to a replaceable portion of a marine drive unit and, more particularly, to a replaceable leading edge portion which is configured to absorb energy during impact in order to prevent damage to a permanent rearward portion of the drive housing structure.

2. Description of the Prior Art

Those skilled in the art of marine drives are aware of many ways in which the drive can be damaged. For example, a gear case of a marine drive can impact a submerged or partially submerged object as a marine vessel passes over that object. Typically, the leading surface of the gear case, skeg, and drive shaft housing can strike the submerged or partially submerged object and cause severe damage to those portions of the marine propulsion unit. Various devices have been suggested for use in providing a replaceable element associated with the marine drive.

U.S. Pat. No. 3,939,795, which issued to Rocka on Feb. 24, 1976, describes an outboard motor protective cover. The cover for the lower portion of an outboard motor includes the skeg, rudder and propeller shaft housing to increase the strength of the motor parts covered and protect such parts against water damage and wear. A reinforcing rib may be added for additional strength and an insert plate may be inserted in the cover to replace a missing skeg.

U.S. Pat. No. 4,832,635, which issued to McCormick on May 23, 1989, discloses a nose construction for the gear case of a marine drive. The drive unit includes a lower propeller torpedo housing of generally cylindrical configuration having a longitudinal centerline. A propeller shaft is mounted in the housing for rotation on an axis offset from the centerline. The shaft is journalled in a forward bearing assembly which is held in place by a support adjustably mounted to the housing and on the offset axis. A nose is removably secured to the forward housing end by a mounting bolt which extends into the support on the offset axis. A single multi-purpose opening or port in the forward end of the nose communicates to an interior entry passage in the nose. The entry passage, in turn, merges into a pair of passage branches. One branch is disposed on the offset propeller shaft axis and receives the mounting bolt. The other branch is positioned to communicate with the cooling water passages in the lower unit and which lead to the marine drive engine. A torque retention and sealing member is disposed between the support and the nose. Furthermore, a torque retention and sealing member is disposed between the bolt head and the inner end of its passage branch.

U.S. Pat. No. 5,000,709, which issued to Bergeron on Mar. 19, 1991, describes a universal nose cone and method for profiling same. The nose cone has a cavity with height, width and depth dimensions to accommodate a plurality of different water craft drive lower housings so that once the nose cone has been suitably profiled a desired one of these lower housings can be adhesively secured to the gear casing for which it was profiled with the edge of the cavity engaging that housing thereby to streamline that lower housing to improve performance of the water craft using that drive housing.

U.S. Pat. No. 5,007,868, which issued to Fry on Apr. 16, 1991, describes a replaceable skeg for a marine propulsion device. The skeg device is provided and includes a tapered dovetail tongue and groove joint between top of the skeg and lower portion of a gear case housing on the marine propulsion device. When the skeg is hit by an underwater obstruction it will fracture at the joint and break away, leaving the lower portion of the gear case housing intact and undamaged in which another skeg can be installed thereto.

U.S. Pat. No. 5,007,869, which issued to Zoellner on Apr. 16, 1991, describes a propeller saving device. The propeller guard device includes a laterally extending fin and a vertical extension or sleeve. The fin and sleeve can be manufactured as a single item. The vertical sleeve is attached to the midline area of the fin with the leading edge of the sleeve being generally co-terminus with the leading edge of the fin. The fin is at least as wide as the rotational path of the propeller blades. The singular fin extends laterally on either side of the sleeve in a generally coplanar relationship. The leading edge of the fin is elevated from three to five degrees higher than the trailing edge of the fin. The trailing edge of the fin is located forwardly of the rotational path of the propeller blades or is lengthened and extends toward the rear of the device to the extent of being even with the midline of the rotational path of the propeller blades.

U.S. Pat. No. 5,178,565, which issued to Jacobson on Jan. 12, 1993, describes a lower unit guard. The guard attachable to the lower unit of an outboard motor is intended to prevent direct impact between submerged hazards and the elements of the lower unit. The guard includes two angle brackets, a rigid bar attached to the angle bracket at a top end, and a skeg pocket and fin attached to a lower portion of the bar. The guard descends from a position forward of and substantially level with the cavitation plate to a point below the. skeg. The guard prevents damage to the entire lower unit, including the propeller, upon impact with a submerged obstacle.

U.S. Pat. No. 5,224,889, which issued to Hickey on Jul. 6, 1993, describes a propeller guard. The device is intended to protect the propeller of a boat from damage caused by striking underwater obstacles. This can occur when the boat is moving in any direction relative to the obstacles. The invention is intended to improve the movement of the boat along the water.

U.S. Pat. No. 5,277,632, which issued to Davis on Jan. 11, 1994, describes a boat motor replacement skeg. An outboard motor replacement skeg is thin and flat and has a cavity formed in one of its edges. The replacement skeg is slid over the stub which remains after the original skeg is broken off and is fastened to the skeg stub with silicone sealant and rivets. As an alternative, the replacement skeg may be part of an original design to replace a specific breakaway skeg having a particular mounting structure.

U.S. Pat. No. 5,399,113, which issued to DeMasi on Mar. 21, 1995, describes a protector against submerged objects. The lower portion of the outdrive of a sterndrive motor or of an outboard motor for boats is further protected from damage on striking submerged objects. Protection at low speed is gained by providing sharp or knife-like edge formed of rubber on the leading of the lower portion to gain the resiliency to cushion from damage at low speeds. Lower portions are typically pivotally mounted with respect to the rest of the motor to enable trim adjustment by a cylinder and piston arrangement.

U.S. Pat. No. 5,501,622, which issued to Phelan on Mar. 26, 1996, describes a marine mammal guard. The guard is intended for use with an outboard motor having a drive shaft housing, an anti-cavitation plate, a lower support unit, a gear casing, a skeg and a propeller hub with a plurality of propeller blades radially extending therefrom. The guard comprises a protective housing having a pair of forward intake ports and a rearward exit port. A mechanism is provided for securing the protective housing to the lower support unit.

U.S. Pat. No. 5,536,188 which issued to Porta on Jul. 16, 1996, describes a nose cone method and apparatus. The nose cone attachment for an outboard motor propeller gear case has a molded polymer housing shaped to fit over the front and sides of the outboard propeller gear case and has an aerodynamic nosepiece shape in the front thereof with a plurality of water inlets thereon. The molded polymer housing has open water channels or plenums therein which form wide passageways with the gear case housing sides when the nose cone attachment is attached over the gear case housing. The open water channels are positioned to fit over the gear case water inlets.

U.S. Pat. No. 5,643,023, which issued to Sober on Jul. 1, 1997, describes a marine engine gear case cover. The skeg cover may be fitted onto either a damaged skeg or a new skeg to prevent shaft, gear, or propeller damage. The invention is constructed such that it is inexpensive and may be quickly and easily installed by a boat owner.

U.S. Pat. No. 5,772,481, which issued to Alexander et al. on Jun. 30, 1998, discloses a skeg construction for a marine propulsion unit. The skeg assembly includes a generally U-shaped saddle that is removably attached to the lower torpedo section of the gear case of the propulsion unit and a thin wedged shaped skeg extends downwardly from the saddle. During planing conditions of the boat, the water line is slightly below the lower torpedo section so that the saddle is out of the water. The side surfaces of the skeg have opposed water intake openings each of which is bordered rearwardly by a laterally projecting shoulder that terminates in a vertical edge and the intake openings are bordered forwardly by a curved surface that connects the side surfaces of the skeg. The water intake openings communicate with a water passage in the skeg which, in turn, communicates with a water passage in the torpedo section so that water can be delivered to the cooling system of the propulsion unit.

U.S. Pat. No. 6,168,483, which issued to McIntosh on Jan. 2, 2001, describes a deflecting propeller guard. The guard comprises a pair of adjacent deflector plates slanting downwardly and rearwardly from a front apex location to provide downwardly and laterally facing deflection surfaces. There is a rear guard section having two guard plates positioned adjacent to one another and extending outwardly and upwardly at a moderate slant from a central axis.

U.S. Pat. No. 6,503,110, which issued to Lammli on Jan. 7, 2003, describes a lower unit guard for an outboard motor. The guard includes a mounting adapted to be secured onto a flange on a housing of a boat motor. The mounting has a leading edge. A skeg receiving pocket is provided which is adapted to receive a skeg of the outboard motor. The skeg receiving pocket is adapted to accommodate in close fitting relation the skeg in its entirety. The skeg receiving pocket has a leading edge, a trailing edge and a bottom edge. A reinforcement member is adapted to fit the contours of a lower unit of the boat motor. The reinforcement member has an upper extremity secured to the leading edge of the mounting and a lower extremity secured to the leading edge of the skeg receiving pocket.

Those skilled in the art of automobile design are familiar with various structures and configurations which are designed for the purpose of absorbing energy and sacrificing the energy absorbing object in order to protect other components.

U.S. Pat. No. 6,406,081, which issued to Mahfet et al. on Jun. 18, 2002, describes an energy absorber system. The system for a vehicle includes an elongated energy absorber including a flanged frame for attachment to a reinforcing beam and a body including a plurality of spaced apart tunable crush boxes capable of deformation and progressive collapse upon impact for absorbing the energy of impact.

U.S. Pat. No. 6,669,251, which issued to Trappe on Dec. 30, 2003, describes a bumper beam and bumper assembly including a bumper beam. The bumper assembly for an automotive vehicle includes a beam and an energy absorber. The energy absorber includes a flanged frame for attachment to the beam and a body extending from the frame. The body includes a first transverse wall, a second transverse wall spaced from the first wall and a plurality of tunable crush boxes extending therebetween. The bumper assembly has greater than fifty percent efficiency.

U.S. Pat. No. 6,679,544, which issued to Hubbert et al. on Jan. 20, 2004, describes a molded energy absorber. The absorber includes two sections connected by a plurality of hinge elements. One section has a plurality of telescopically crushable tubular cylinders integrally molded thereon. The two sections are folded together and the energy absorber attaches to a structural vehicle pillar on the inside of the vehicle. Upon impact, the tubular cylinders are fractured and crush telescopically, thereby dissipating much of the impact energy.

U.S. patent application Ser. No. (M09719), which was filed by Misorski et al. on Feb. 17, 2004, discloses a marine drive unit overmolded with a polymer material. A marine propulsion system drive unit is provided with a polymer layer to protect its outer surface from abrasion and corrosion. The polymer layer is injection molded around the outer surface of a metallic gear case structure or drive shaft housing to provide a coat which is approximately three millimeters thick and which will resist scratching and corrosion. The polymer layer can be a glass filled polymer or a carbon filled polymer. An adhesion promoter can be used to enhance the bonding and intimate contact between the inner surface of the polymer layer and the outer surface of the metallic gear case structure or drive shaft housing.

The patents described above are hereby expressly incorporated by reference in the description of the present invention.

Various types of components and devices are familiar to those skilled in the art for the purpose of attaching those components to marine propulsion devices for the purpose of protecting or replacing portions of the marine drive housing. These components, as described above, can be used to protect or replace the skeg and other leading portions of the marine drive housing. In addition, those skilled in the art of energy absorption are familiar with various types of structures and configurations that are particularly designed to absorb energy during an impact with another object so that other components can be protected from damage during that impact.

It would be significantly beneficial if a marine drive unit could be protected by providing a leading edge structure that absorbs energy in the event of an impact with a submerged or partially submerged object, such as a log, in a way that protects the majority of the submerged portion of the drive housing from damage. It would also be significantly beneficial if this type of protection device could be easily installed and accurately positioned. when replacement of a damaged device is necessary. It would also be significantly beneficial if the replacement device could be configured in such a way so as to facilitate the introduction of water into the drive unit so that the water can be conducted upwardly into the cooling passages of an engine that is associated with the drive structure.

SUMMARY OF THE INVENTION

A marine propulsion device, made in accordance with a preferred embodiment of the present invention, comprises the first portion of a housing structure which is at least partially submerged when the marine propulsion device is in operation, a drive shaft disposed within the first portion, and a propeller shaft disposed within the first portion and connected in torque transmitting relation with the drive shaft. It also comprises a second portion of the housing structure which is at least partially submerged when the marine propulsion device is in operation. The second portion is removably attachable to the first portion.

The first portion can comprise a first mating surface and the second portion can comprise a second mating surface. The first and second mating surfaces are disposed in contact with each other when the second portion is attached to the first portion. The second portion can comprise a fluid conduit extending through an exposed surface of the second portion and also through the second mating surface. The exposed surface of the second portion extends in a forward direction from the first portion when the marine propulsion device is in operation. The first conduit is disposed in fluid communication with a first recess formed in the exposed surface of the second portion and a fastener can be inserted within the first recess and through the second portion to attach the first and second portions together.

The first and second portions are configured to cause the first portion to yield to a first magnitude of impact and the second portion to yield to a second magnitude of impact, wherein the second magnitude of impact is less than the first magnitude of impact. The second portion can be configured to have at least one cavity formed within its structure in order to cause the second magnitude of impact to be less than the first magnitude of impact.

The first portion has a generally flat front surface. The front surface is shaped to receive the second portion thereon. First and second alignment pins can be insertable into openings formed in the first and second portions in order to align the first and second portions together and retain them in a desired position. A fluid conduit can extend through the second portion and in fluid communication with the first opening.

The first portion can be overmolded with a polymer material. In addition, the first portion can be made of a different material than the second portion. In one such application, the first portion is made of aluminum and the second portion is made of a polymer material. Either or both of the first and second portions can be coated with a polymer material. The second portion can be made of a composite material. The second portion is intentionally configured to be more crushable than the first portion and the second portion can comprise at least one crush box formed within its structure. The second portion is configured to crush more easily than the first portion in response to a force exerted on it in a direction from in front of the second portion when the marine propulsion device is in operation. In certain embodiments, the second portion can be configured to compress in response to an impact by a force exerted on it in a direction from in front of the second portion when the marine propulsion device is in operation and subsequently resiliently return to its shape prior to the impact. The second portion can also be configured to absorb a force exerted on it in a direction from in front of the second portion when the marine propulsion device is in operation without resiliently returning to its original shape.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
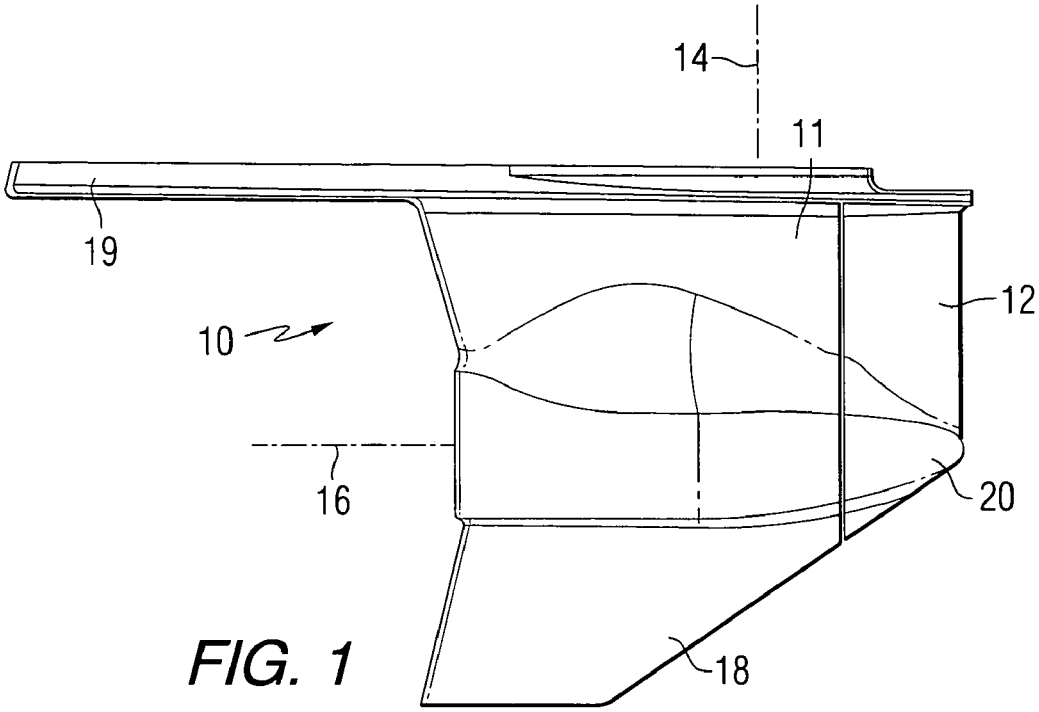
FIG. 1 is a side view of a marine propulsion device made in accordance with the present invention.

Throughout the description of the preferred embodiment of the present invention, like components will be identified by like reference numerals.

FIG. 1 is a side view of a gear case incorporating the present invention. Reference numeral 10 is used to designate the combined housing structure of the marine propulsion device that provides its gear case. A first portion 11 of the housing structure is intended to support and protect a drive shaft which rotates about a drive shaft axis 14 and a propeller shaft which rotates about a propeller shaft axis 16. Although the drive shaft and propeller shaft are not illustrated in FIG. 1, it should be understood that these components are well known to those skilled in the art and can be of a conventional design. A second portion 12 of the housing structure 10 is removably attachable to the first portion 11. Also shown in FIG. 1 is a skeg 18 and an anticavitation plate 19. The second portion 12 comprises a nose cone 20 that is shaped to conform to a contour of the propeller shaft housing portion of the marine propulsion device.

Figure 2:
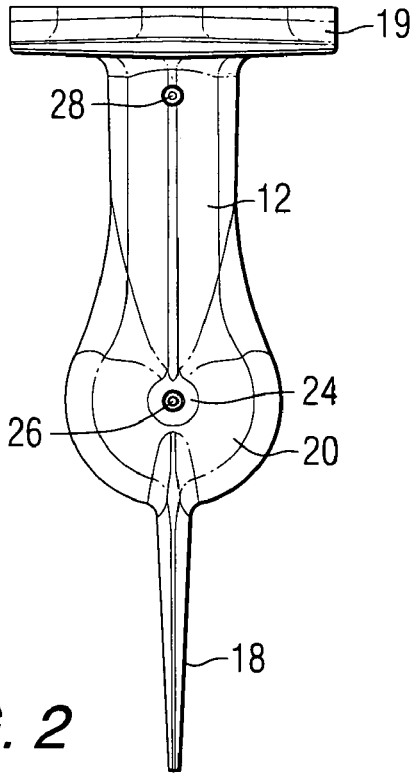
FIG. 2 is a front view of the illustration in FIG. 1.

FIG. 2 is an end view of the structure shown in FIG. 1. At the leading portion 24 of the nose cone 20, a first recess 26 is provided. As will be described in greater detail below, this first recess serves a dual purpose in a preferred embodiment of the present invention. First, as does a second recess 28, the first recess 26 provides an opening through which a fastener can be inserted to attach the first and second portions, 11 and 12, together. In addition, the first recess 26 serves an additional purpose of providing a passageway through which water can flow into and through the second portion 12 for use in the cooling system of an engine associated with the marine propulsion device.

Figure 3:
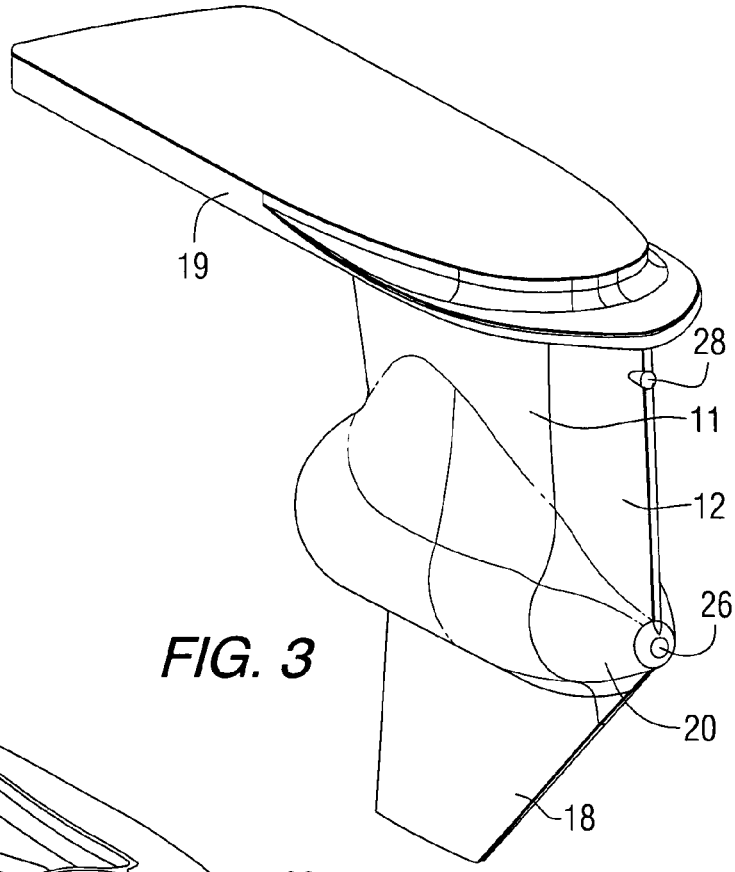
FIG. 3 is an isometric view of the marine drive.

FIG. 3 is an isometric view of the marine propulsion device made in accordance with a preferred embodiment of the present invention. The first and second recesses, 26 and 28, can be seen at their positions extending through the exposed leading surface of the second portion 12. Also shown in FIG. 3 is the skeg 18 and the nose cone 20 of the gear case.

Figure 4:
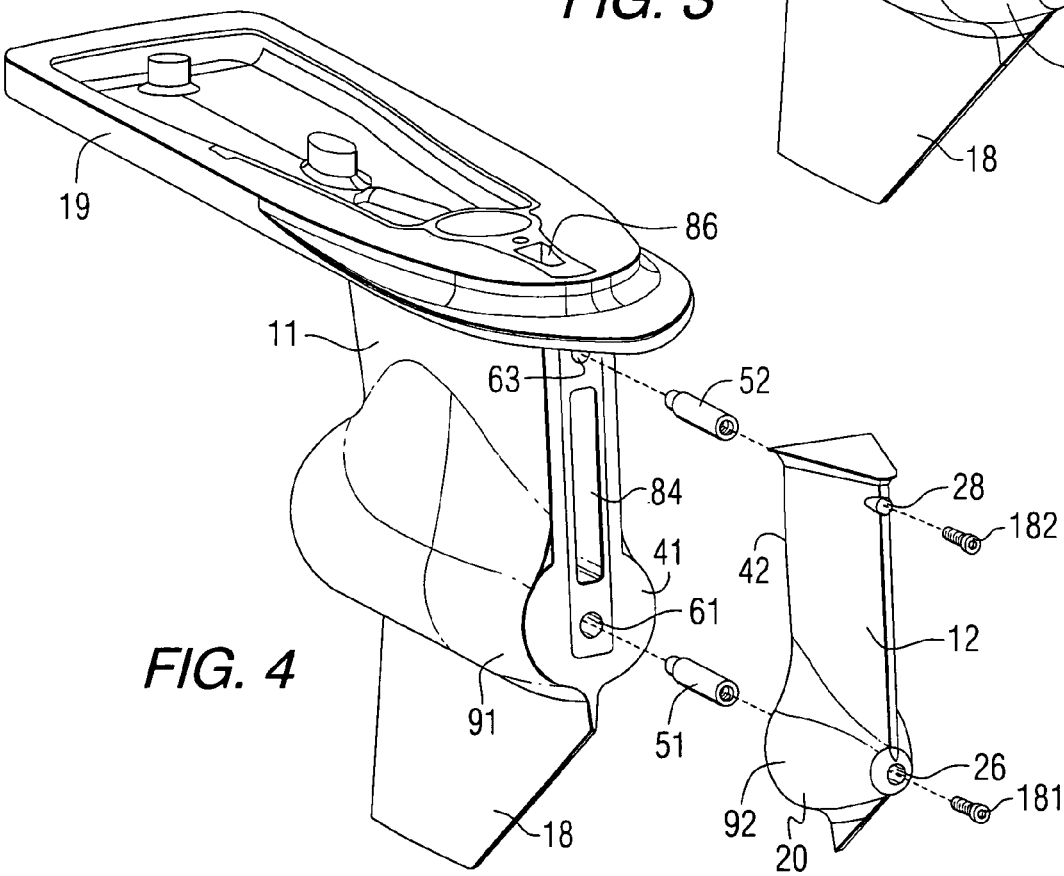
FIG. 4 is an exploded isometric view of the marine drive.

FIG. 4 is generally similar to FIG. 3, but provides an exploded isometric view of the marine propulsion device made in accordance with a preferred embodiment of the present invention. The first portion 11 has a first mating surface 41 and the second portion 12 has a second mating surface 42. The first and second mating surfaces, 41 and 42, are disposed in contact with each other when the second portion 12 is attached to the first portion 11. A first alignment pin 51 is insertable into a first opening 61 formed in the first portion 11 and into a second opening 62 (not shown in FIG. 4, but shown in FIG. 5) formed in the second portion 12. A second alignment pin 52 is insertable into a third opening 63 formed in the first portion 11 and into a fourth opening 64 (not shown in FIG. 4, but shown in FIG. 5) formed in the second portion 12.

Figure 5:
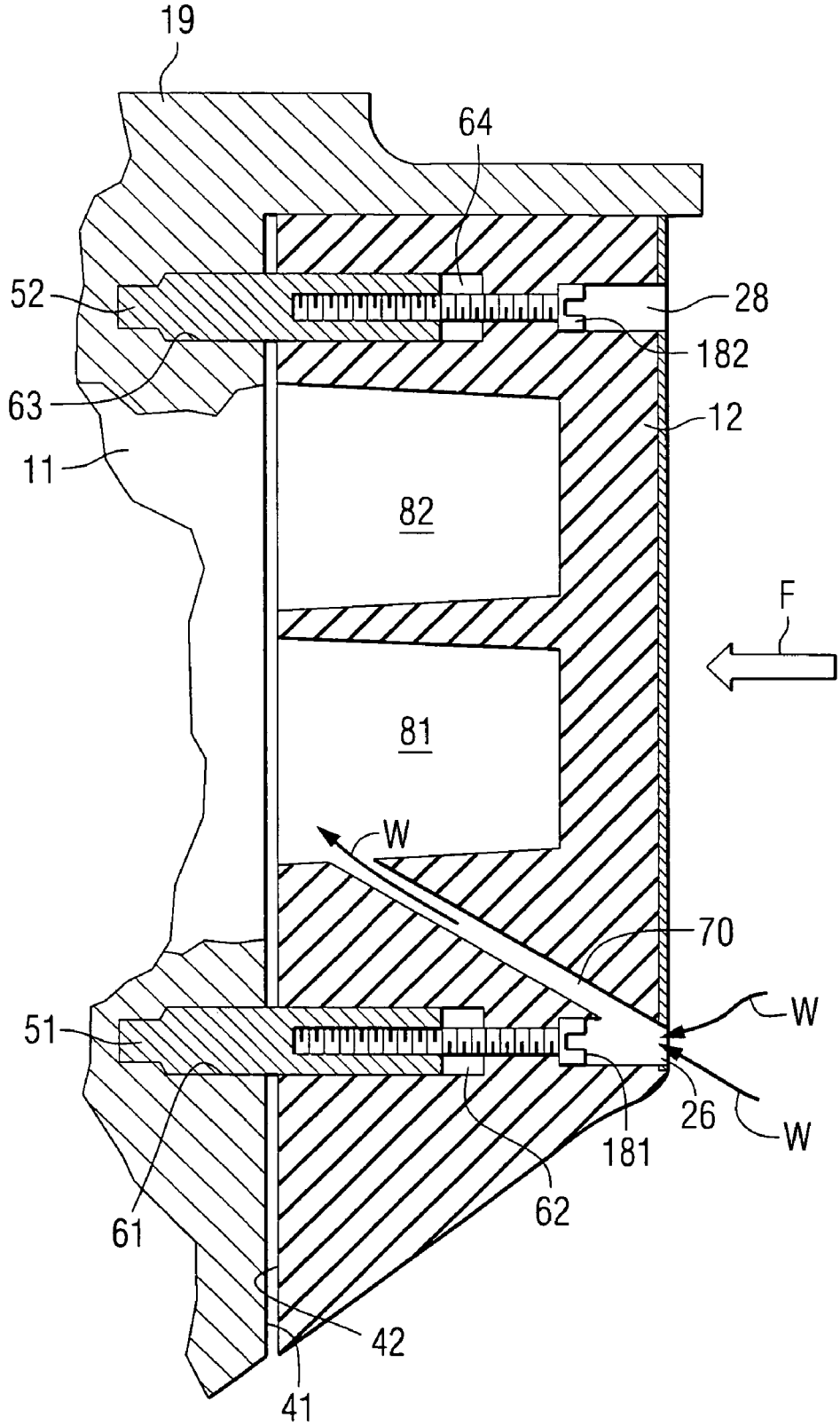
FIG. 5 is a partial section view of the first and second portions of the present invention.

FIG. 5 is a section view of the second portion 12 and a partial sectioned view of the first portion 11. The relationship between the first mating surface 41 and the second mating surface 42 is shown. The first alignment pin 51 is shown inserted into the first opening 61 formed in the first portion 11 and also into the second opening 62 formed in the second portion 12. In addition, the second alignment pin 52 is shown inserted into the third opening 63 which is formed in the first portion 11 and the fourth opening 64 formed in the second portion 12. The fluid conduit 70 extends through the second portion 12 and in fluid communication with the recess 26 which is part of the second opening. A first fastener 181 can be disposed through the recess 26 and into the first alignment pin 51 in order to retain the first alignment pin and the second portion 12 together. A second fastener 182 can be inserted through the second recess 28 to attach the second alignment pin 52 to the second portion 12. In a preferred embodiment of the present invention, the first and second alignment pins, 51 and 52, are threaded so that they can be attached to the first portion 11 in threaded relation therewith. These alignment pins, 51 and 52, serve the dual purposes of assisting the alignment of the first and second portions, 11 and 12, during assembly and also attaching the first and second portions together in combination with the first and second fasteners, 181 and 182. The first and second alignment pins, 51 and 52, are shaped to be received in the first, second, third, and fourth openings with minimal clearance in order to facilitate the precise alignment of the first and second portions, 11 and 12, with a high degree of accuracy in order to maintain a smooth contoured outer surface where the exposed surfaces of the first and second portions meet.

With continued reference to FIG. 5, at least one cavity is formed in the second portion 12. In the illustration of FIG. 5, two such cavities, 81 and 82, are shown. The water conduit 70 directs a flow of water from the first recess 26 to the first cavity 81. Water flows, in the direction represented by the arrows W in FIG. 5, from the first recess 26, through the conduit 70, and into the first cavity 81. With reference to FIGS. 4 and 5, the water can then flow into a larger cavity 84 in the first portion 11 and upwardly through a vertical conduit 86 toward the cooling system of an internal combustion engine used in conjunction with the marine propulsion device. The cavities, 81 and 82, serve as crush boxes which weaken the second portion 12 relative to the strength of the first portion 11. When the marine propulsion device experiences an impact force in the direction represented by arrow F in FIG. 5, the overall material and structure of the second portion 12 cause the second portion 12 to absorb the energy of that impact in order to protect the first portion 11 from significant damage. Various configurations of the second portion 12 can be used to determine the response of the second portion when the impact occurs. For example, the use of crush boxes, 81 and 82, can induce the second portion 12 to crush more easily than the first portion 11 in response to the force F which is exerted on it in a direction from in front of the second portion 12 when the marine propulsion device is in operation. Alternatively, certain materials can be selected for the second portion 12 which allow it to compress in response to an impact by the force F exerted on it and subsequently resiliently return to its shape prior to the impact. This reaction would occur if the second portion 12 is made of a resilient material, such as synthetic rubber. Even when the resilient material is coated with a harder polymer material, the overall structure of the second portion 12 can compress and then resiliently return to its original shape prior to impact. Another alternative configuration of the second portion 12 could be to make it from a nonresilient, but conformable, material such as an impact deadening compliant material. While this nonresilient material might not return to its original shape, it can provide the additional benefit of absorbing energy during impact and reducing the resulting movement of the marine propulsion device subsequent to impact.

With reference to FIGS. 1–5, it can be seen that a marine propulsion device made in accordance with a preferred embodiment of the present invention comprises a first portion 11 of a housing structure which is at least partially submerged when a marine propulsion device is in operation. It also comprises a second portion 12 of the housing structure. The second portion 12 is removably attachable to the first portion. The first portion comprises a first mating surface 41 and the second portion comprises a second mating surface 42. The first and second mating surfaces are in disposing contact with each other when the second portion 12 is attached to the first portion 11. The second portion comprises a fluid conduit 70 that extends through an exposed surface of the second portion 12 and through the second mating surface 42. The first conduit 70 incorporates the first cavity 81 in the embodiment illustrated in FIG. 5.

With continued reference to FIGS. 1–5, the exposed surfaces of the first and second portions, 11 and 12, are identified by reference numerals 91 and 92. The exposed surface 92 of the second portion 12 extends in a forward direction from the first portion 11 when the marine propulsion device is in operation. The first conduit 70 is disposed in fluid communication with a first recess 26 that is formed in the exposed surface 92 of the second portion 12. A fastener 181 is inserted within the first recess 26 and through the second portion 12 to attach the first and second portions together. A second fastener 182 similarly extends through a second recess 28 to attach the first and second portions, 11 and 12, together.

The first and second portions, 11 and 12, are configured to cause the first portion 11 to yield to a first magnitude of impact and the second portion 12 to yield to a second magnitude of impact, wherein the second magnitude of impact is less than the first magnitude of impact. The second portion 12 is configured to have at least one cavity 81 formed with in its structure in order to cause the second magnitude of impact to be less than the first magnitude of impact. The first portion 11 has a generally flat front surface 41, as the mating surface, that is shaped to receive the second portion 12 thereon. The first and second alignment pins, 51 and 52, are insertable into openings, 61 and 63, formed in the first portion 11 and into openings, 62 and 64, formed in the second portion 12. The fluid conduit 70 extends through the second portion 12 and in fluid communication with the second opening 62.

With continued reference to FIGS. 1–5, it should be understood that in a particularly preferred embodiment of the present invention, the first portion 11 is overmolded with a polymer material. This type of overmolding procedure can be done in accordance with the procedures described in the patent application described above in conjunction with the marine drive unit overmolded with a polymer material (M09719). Although the overmolding material is relatively thin and difficult to illustrate clearly in the figures, it should be understood that the metallic gear case of the first portion 11, for example, can be made of aluminum and the polymer overmolded layer can comprise either an unfilled polymer, a glass filled polymer, or a carbon filled polymer. In some applications, an adhesion promoting substance is used to facilitate the adhesion of the polymer overmolded layer to an outer surface of the gear case. The adhesion promoting substance can be disposed within the polymer overmolded layer before it is applied to the gear case or it can be disposed between the metallic gear case and the polymer overmolded layer prior to the polymer overmolded layer being injection molded around the middle gear case. A polymer that can be used for these purposes can be a material which is sold under the trademark SURLYN, a material sold under the trademark RYNITE, or a material sold under the trademark HYTREL. All of these materials are available in commercial quantities from the DuPont Corporation. The adhesion promoting substances can be Zytel ST801 which is available in commercial quantities from the DuPont Corporation. In addition, another adhesion promoter that can be used is referred to as Epoxy E120HP which is available in commercial quantities from the Loctite Corporation. In a typical application of an overmolded polymer material, the outer surface of the gear case is completely coated with the polymer overmolded layer which is generally approximately 0.12 inches (3 mm) thick and is adhered to the surface of the gear case in an intimate fashion with little or no space between the inner surface of the polymer overmolded layer and the outer surface of the metallic gear case. It should be understood that alternative materials can also be used as an overmolded coating on the gear case, particularly on the exposed surfaces of the first portion 11. Alternatively, it should be understood that the present invention is not dependent on the first portion 11 being overmolded with such a coating. The first portion 11 can be made of a different material than the second portion 12. As described above, the first portion can be made of aluminum and the second portion can be made of a polymer material. The second portion can be made of a composite material which can comprise an overmolded polymer coating that surrounds a structure of a resilient material, such as synthetic rubber. Alternatively, the second portion 12 can be entirely made of a polymer material.

The second portion 12 is configured to be more crushable than the first portion 11. The second portion can comprise at least one crush box 81 formed within its structure in order to configure the second portion 12 to be more easily crushed than the first portion 11 in response to a force F exerted on it in a direction from in front of the second portion 12 when the marine propulsion device is in operation. The second portion 12 can be configured to compress and then subsequently resiliently return to its shape prior to the impact. Certain embodiments of the present invention can configure the second portion 12 to absorb a force, in a nonresilient manner, in order to further protect the other components of the marine propulsion device.

Although the present invention has been described in particular detail and illustrated to show a preferred embodiment, it should be understood that alternative embodiments are also within its scope.

We claim:

1. A marine propulsion device, comprising:

a first portion of a housing structure which is at least partially submerged when said marine propulsion device is in operation;

a drive shaft disposed within said first portion;

a propeller shaft disposed within said first portion and connected in torque transmitting relation with said drive shaft; and a second portion of said housing structure which is at least partially submerged when said marine propulsion device is in operation, said second portion being removably attachable to said first portion said first portion comprising a first mating surface, said second portion comprising a second mating surface, said first and second mating surfaces being disposed in contact with each other when said second portion is attached to said first portion, said second portion comprising a fluid conduit extending through an exposed surface of said second portion and through said second mating surface, said exposed surface of said second portion extending in a forward direction from said first portion when said marine propulsion device is in operation, said first conduit being disposed in fluid communication with a first recess formed in said exposed surface of said second portion, a fastener being inserted within said first recess and through said second portion to attach said first and second portions together.

2. The marine propulsion device of claim 1, wherein:

said first and second portions are configured to cause said first portion to yield to a first magnitude of impact and said second portion to yield to a second magnitude of impact, wherein said second magnitude of impact is less than said first magnitude of impact.

3. The marine propulsion device of claim 2, wherein:

said second portion is configured to have at least one cavity formed within its structure in order to cause said second magnitude of impact to be less than said first magnitude of impact.

4. The marine propulsion device of claim 1, wherein:

said first portion has a generally flat front surface, said front surface being shaped to receive said second portion thereon.

5. The marine propulsion device of claim 1, further comprising:

a first alignment pin being insertable into a first opening formed in said first portion and into a second opening formed in said second portion.

6. The marine propulsion device of claim 5, further comprising:

a second alignment pin being insertable into a third opening formed in said first portion and into a fourth opening formed in said second portion.

7. The marine propulsion device of claim 5, further comprising:

a fluid conduit extending through said second portion and in fluid communication with said first recess.

8. The marine propulsion device of claim 1, wherein:

said first portion is overmolded with a polymer material.

9. The marine propulsion device of claim 1, wherein:

said first portion is made of a different material than said second portion.

10. The marine propulsion device of claim 1, wherein:

said second portion is made of a composite material.

11. The marine propulsion device of claim 1, wherein:

said second portion is made of a polymer material.

12. The marine propulsion device of claim 1, wherein:

said second portion is configured to be more crushable than said first portion.

13. The marine propulsion device of claim 1, wherein:

said second portion comprises at least one crush box formed within its structure.

14. The marine propulsion device of claim 1, wherein:

said second portion is configured to crush more easily than said first portion in response to a force exerted on it in a direction from in front of said second portion when said marine propulsion device is in operation.

15. The marine propulsion device of claim 1, wherein:

said second portion is configured to compress in response to an impact by a force exerted on it in a direction from in front of said second portion when said marine propulsion device is in operation and subsequently resiliently return to its shape prior to said impact.

16. The marine propulsion device of claim 1, wherein:

said second portion is configured to absorb a force exerted on it in a direction from in front of said second portion when said marine propulsion device is in operation.

17. A marine propulsion device, comprising:

a first portion of a housing structure which is at least partially submerged when said marine propulsion device is in operation;

a drive shaft disposed within said first portion;

a propeller shaft disposed within said first portion and connected in torque transmitting relation with said drive shaft;

a second portion of said housing structure which is at least partially submerged when said marine propulsion device is in operation, said second portion being removably attachable to said first portion;

a first alignment pin being shaped to be received in both a first opening formed in said first portion and a second opening formed in said second portion; and a second alignment pin shaped to be received in both a third opening formed in said first portion and a fourth opening formed in said second portion said first portion comprising a first mating surface, said second portion comprising a second mating surface, said first and second mating surfaces being disposed in contact with each other when said second portion is attached to said first portion, said second portion comprising a fluid conduit extending through an exposed surface of said second portion and through said second mating surface, said exposed surface of said second portion extending in a forward direction from said first portion when said marine propulsion device is in operation, said first conduit being disposed in fluid communication with a first recess formed in said exposed surface of said second portion, a fastener being inserted within said first recess and through said second portion to attach said first and second portions together.

18. The marine propulsion device of claim 17, wherein:

said first and second portions are configured to cause said first portion to yield to a first magnitude of impact and said second portion to yield to a second magnitude of impact, wherein said second magnitude of impact is less than said first magnitude of impact.

19. The marine propulsion device of claim 18, wherein:

said second portion is configured to have at least one cavity formed within its structure in order to cause said second magnitude of impact to be less than said first magnitude of impact.

20. The marine propulsion device of claim 17, wherein:

said first portion has a generally flat front surface, said front surface being shaped to receive said second portion thereon.

21. The marine propulsion device of claim 17, wherein:

said second portion is configured to crush more easily than said first portion in response to a force exerted on it in a direction from in front of said second portion when said marine propulsion device is in operation.

22. The marine propulsion device of claim 17, wherein:

said second portion is configured to compress in response to an impact by a force exerted on it in a direction from in front of said second portion when said marine propulsion device is in operation and subsequently resiliently return to its shape prior to said impact.

23. The marine propulsion device of claim 17, wherein:

said second portion is configured to absorb a force exerted on it in a direction from in front of said second portion when said marine propulsion device is in operation.

24. A marine propulsion device, comprising:

a first portion of a housing structure which is at least partially submerged when said marine propulsion device is in operation;

a drive shaft disposed within said first portion;

a propeller shaft disposed within said first portion and connected in torque transmitting relation with said drive shaft;

a second portion of said housing structure which is at least partially submerged when said marine propulsion device is in operation, said second portion being removably attachable to said first portion;

a first alignment pin being insertable into a first opening formed in said first portion and into a second opening formed in said second portion; and a fluid conduit extending through said second portion and in fluid communication with a first recess.

* * * * *